US007341361B2

(12) United States Patent
Gagne

(10) Patent No.: US 7,341,361 B2
(45) Date of Patent: Mar. 11, 2008

(54) AUXILIARY LIGHT SOURCE FOR SELF-CONTAINED BREATHING MASKS

(76) Inventor: Roy Gagne, 240 Newtown Ave., Norwalk, CT (US) 06851

( * ) Notice: Subject to any disclaimer, the term of this patent is extended or adjusted under 35 U.S.C. 154(b) by 396 days.

(21) Appl. No.: 10/963,472

(22) Filed: Oct. 13, 2004

(65) Prior Publication Data

US 2005/0047116 A1 Mar. 3, 2005

(51) Int. Cl.
*F21V 23/04* (2006.01)

(52) U.S. Cl. ..... 362/251; 362/105; 362/223; 362/235; 2/906

(58) Field of Classification Search ..... 362/105, 362/106, 251; 2/905
See application file for complete search history.

(56) References Cited

U.S. PATENT DOCUMENTS 3,227,866 A 1/1966 Peters et al.
5,063,938 A 11/1991 Beck et al.
5,138,723 A * 8/1992 Bolle ..... 2/430
5,224,772 A * 7/1993 Fustos ..... 362/105
5,408,393 A 4/1995 Becker
5,564,128 A 10/1996 Richardson
D382,341 S 8/1997 Freund
5,764,203 A 6/1998 Holmlund et al.
5,990,793 A 11/1999 Bieback
2003/0076676 A1* 4/2003 Gordon et al. ..... 362/185
2005/0099798 A1* 5/2005 Cugini et al. ..... 362/105

* cited by examiner

*Primary Examiner*—Ali Alavi
*Assistant Examiner*—Evan Dzierzynski

(57) ABSTRACT

An auxiliary light source includes a plurality of illuminable light-emitting sources and a plurality of opaque reflectors. A plurality of substantially rectangular transparent lenses are positioned over the light-emitting sources. Each lens includes a plurality of integrally disposed finger portions defining mounting brackets engageable with the mask support rim. The device further includes a central panel secured to the mask support rim by a fastening member and a plurality of flexible rubber seals sandwiched between the panel and the lenses respectively. A control switch and a power supply source are electrically coupled thereto and to the light-emitting sources respectively.

6 Claims, 1 Drawing Sheet

AUXILIARY LIGHT SOURCE FOR SELF-CONTAINED BREATHING MASKS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a light source and, more particularly, to an auxiliary light source for self-contained breathing masks.

2. Prior Art

Police, firemen, miners and others who are required to enter or work in areas of little or no ambient illumination must carry with them some form of artificial light in order to perform their work and avoid hazards. Safety lights mounted on various parts of a user's body including head coverings are known in the prior art. The workers typically use safety helmets to protect their heads from falling rocks, timbers, tools, debris and other objects. In order to leave the worker's hands free, it is desirable to attach a light source to the protective helmet so that it shines forward in the direction in which the user faces when the helmet is worn in its normal position.

In some prior art systems, firemen's helmets are provided with front and rear lights. The helmets include both a front light assembly and a rear light assembly, however, such light assemblies have halogen light bulbs which provide for relatively high heat output and do not provide for the advantages of a light emitting diode type assembly.

While prior art versions of helmet mounted head lamps are useful, they suffer from a number of disadvantages. For example, the area of illumination is typically limited to a cone shaped region directly in front of the user which is narrower than the typical person's field of view. Under these circumstances, hazardous objects at the periphery of a person's vision are not illuminated by the head lamp, thus exposing the user to unexpected injury from objects outside of the comparatively small illuminated area or requiring the user to constantly move his or her head from side to side and up and down to sequentially illuminate adjacent regions.

A second problem with present day helmet mounted head lamps is that they often interfere with a protective face mask attached to the user's helmet. For example, the head lamp prevents the protective mask from being raised out of the way if it becomes damaged or interferes with the user's ability to help a victim (e.g., when mouth to mouth resuscitation is needed). Under these circumstances, the user may need to remove the helmet or tip it back out of the way, thereby increasing his or her risk of injury because its protective function has been compromised.

Accordingly, a need remains for an auxiliary light source for self-contained breathing masks in order to overcome the above-noted shortcomings. The present invention satisfies such a need by providing a light source that is safer to use, small in size, reliable, and provides efficient and superior illumination. Such a light source's small size advantageously adds little weight to any attached mask. The light emitting diodes offer superior illumination, durability and reliability in comparison to traditional light sources.

BRIEF SUMMARY OF THE INVENTION

In view of the foregoing background, it is therefore an object of the present invention to provide an auxiliary light source for self-contained breathing masks. These and other objects, features, and advantages of the invention are provided by a device attachable to an existing self-contained breathing mask that has a support rim and a transparent shield supported thereby along a frontal portion of the mask.

The device includes a plurality of illuminable light-emitting sources and a plurality of opaque reflectors positioned rearwardly of the light-emitting sources for conveniently directing light rays forwardly therefrom along a predetermined line of sight defined in front of a user. A plurality of substantially rectangular transparent lenses are positioned over selected groups of the light-emitting sources respectively and are spaced apart along a width of the mask such that the lenses can advantageously be attached to the mask support rim. Each such lens includes a plurality of integrally disposed finger portions defining mounting brackets.

The mounting brackets extend rearwardly of the lenses and are engageable with the mask support rim for assisting to maintain the lenses at a substantially stable position during operating conditions. Such mounting brackets preferably extend rearwardly beyond the light-emitting sources and the reflector for assisting to maintain the light rays reflected therefrom at a substantially fixed path. The device preferably further includes a plurality of fastening members for threadably connecting the lenses to the mask support rim.

A central panel is secured to the mask support rim by a fastening member. Such a panel is medially positioned between the lenses and is formed from non-corrosive material so that the light-emitting sources are not affected by the presence of atmospheric moisture.

A plurality of flexible rubber seals are sandwiched between the panel and the lenses respectively such that the light rays are advantageously directed forwardly of the mask and not laterally across a central portion of the mask shield.

A control switch and a power supply source are electrically coupled thereto and to the light-emitting sources respectively such that a user may readily toggle the device between operating and non-operating modes while the mask is positioned over the user's head. Such a power supply source preferably includes a battery pack oppositely disposed from the control switch.

The device may further include a plurality of glare shields connected to the lenses for cooperating with the rubber seals in advantageously assisting to channel the light rays away from the mask shield. Such glare shields extend forwardly from the lenses at an angle offset from a horizontal plane and are preferably formed from an opaque material.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
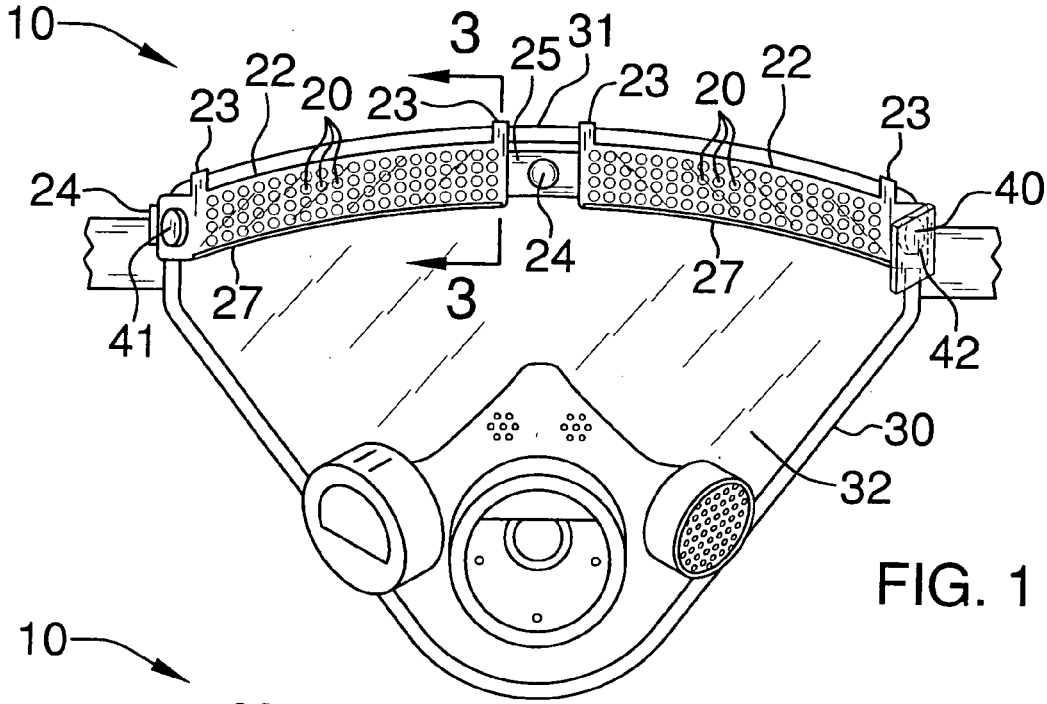
FIG. 1 is a front elevational view showing an auxiliary light source for self-contained breathing masks, in accordance with the present invention.
Figure 2:
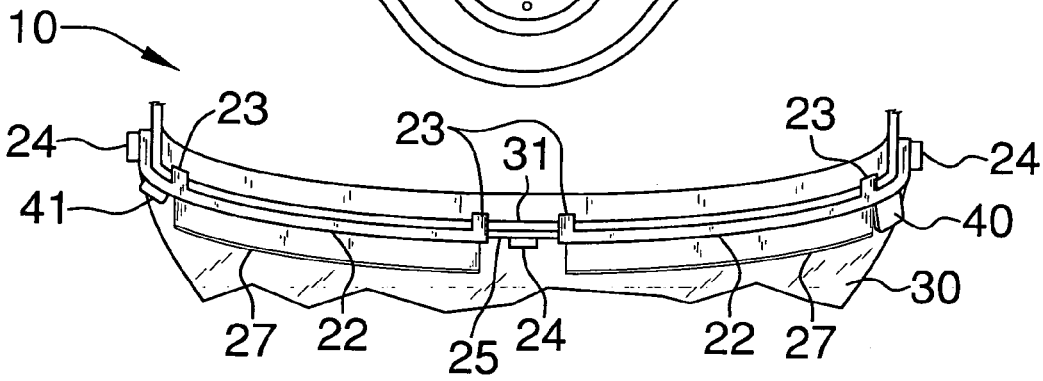
FIG. 2 is top plan view of the device shown in FIG. 1.
Figure 3:
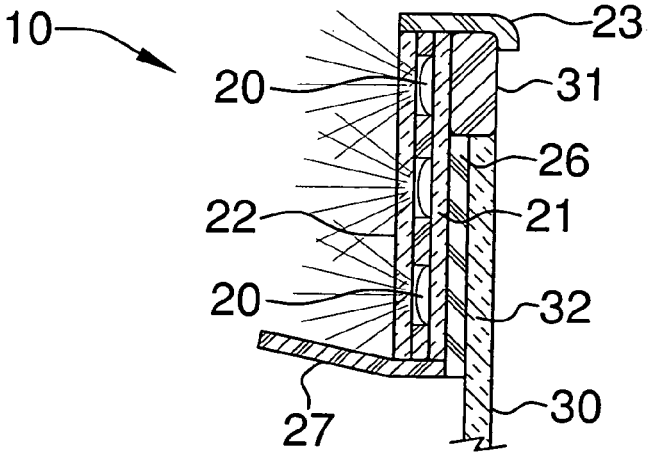
FIG. 3 is a cross-sectional view of the device shown in FIG. 1, taken along line 3-3.

The device of this invention is referred to generally in FIGS. 1-3 by the reference numeral 10 and is intended to provide an auxiliary light source for self-contained breathing masks. It should be understood that the device 10 may be used to provide light to many different types of masks and should not be limited to only self-contained breathing masks.

Referring initially to FIGS. 1 and 2, the device 10 includes a plurality of illuminable light-emitting sources 20 and a plurality of opaque reflectors 21 positioned rearwardly of the light-emitting sources 20 for conveniently directing light rays forwardly therefrom along a predetermined line of sight defined in front of a user. A plurality of substantially rectangular transparent lenses 22 are positioned over selected groups of the light-emitting sources 20 respectively and are spaced apart along a width of the mask 30 such that the lenses 22 can advantageously be attached to the mask support rim 31. Each such lens 22 includes a plurality of integrally disposed finger portions defining mounting brackets 23.

Referring to FIGS. 1, 2 and 3, the mounting brackets 23 extend rearwardly of the lenses 22 and are engageable with the mask support rim 31 for assisting to maintain the lenses 22 at a substantially stable position during operating conditions. Such mounting brackets 23 extend rearwardly beyond the light-emitting sources 20 and the reflector 21 for assisting to maintain the light rays reflected therefrom at a substantially fixed path. The device 10 further includes a plurality of fastening members 24 for threadably connecting the lenses 22 to the mask support rim 31.

Referring to FIGS. 1 and 2, a central panel 25 is secured to the mask support rim 31 by a fastening member 24. Such a panel 25 is medially positioned between the lenses 22 and is formed from non-corrosive material so that the light-emitting sources 20 advantageously are not affected by the presence of atmospheric moisture. This feature ensures the longevity of the light emitting sources 20, especially during the strenuous conditions they will be operating in.

Referring to FIG. 3, a plurality of flexible rubber seals 26 are sandwiched between the panel 25 and the lenses 22 respectively such that the light rays are advantageously directed forwardly of the mask 30 and not laterally across a central portion of the mask shield 32, thus improving an individual's line of sight during operating conditions.

Referring to FIGS. 1 and 2, a control switch 41 and a power supply source 40 are electrically coupled thereto and to the light-emitting sources 20 respectively such that a user may readily toggle the device 10 between operating and non-operating modes while the mask 30 is positioned over the user's head. Such a power supply source 40 includes a battery pack 42 oppositely disposed from the control switch 41.

Referring to FIGS. 2 and 3, the device 10 further includes a plurality of glare shields 27 connected to the lenses 22 for cooperating with the rubber seals 26 in advantageously assisting to channel the light rays away from the mask shield 32 and thus further improving the vision of an individual wearing the mask 30. In emergency situations, this becomes particularly important when the need to locate an injured or missing individual arises, especially when smoke and other debris are already impeding one's vision. Such glare shields 27 extend forwardly from the lenses 22 at an angle offset from a horizontal plane and are formed from an opaque material.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device attachable to an existing self-contained breathing mask having a support rim and transparent shield supported thereby along a frontal portion of the mask, said device comprising:

a plurality of illuminable light-emitting sources;

a plurality of opaque reflectors positioned rearwardly of said light-emitting sources for directing light rays forwardly therefrom along a predetermined line of sight defined in front of a user;

a plurality of substantially rectangular transparent lenses positioned over selected groups of said light-emitting sources respectively and being spaced apart along a width of the mask such that said lenses are attached to the mask support rim, each said lens comprising a plurality of integrally disposed finger portions defining mounting brackets, said mounting brackets extending rearwardly of said lenses and being engaged with the mask support rim for assisting to maintain said lenses at a substantially stable position during operating conditions;

a central panel secured to the mask support rim by a fastening member, said panel be medially positioned between said lenses, said panel being formed from non-corrosive material so that said light-emitting sources do not become contaminated in the presence of atmospheric moisture;

a plurality of flexible rubber seals sandwiched between said panel and said lenses respectively such that the light rays are directed forwardly of the mask and not laterally across a central portion of the mask shield; and a control switch and a power supply source electrically coupled thereto and to said light-emitting sources respectively such that a user may readily toggle said device between operating and non-operating modes while the mask is positioned over the user's head;

wherein said light emitting sources are displayed along a plurality of vertically stacked linear rows extending laterally towards outer edges of said mask; each of said light emitting sources maintain a static relationship with said finger portions;

wherein said reflectors are directly abutted against a rear side of said light emitting sources and travel along a vertical plane;

wherein each of said finger portions extend upwardly and rearwardly about a top edge of said mask support rim such that said finger portions maintain direct frictional contact therewith;

wherein said rubber seals are directly abutted against said panel and said lenses respectively;

wherein said control switch and said battery supply source are directly connected to said lens and positioned adjacent to a top end of said mask support rim;

wherein said central panel has directly opposed ends directly abutted with inner said walls with said lenses such that said lenses maintain a spatial distance equal to a width of said central panel.

2. The device of claim 1, further comprising: a plurality of glare shields connected to said lenses for cooperating with said rubber seals and assisting to channel the light rays away from the mask shield, said glare shield extending forwardly from said lenses at an angle offset from a horizontal plane;

wherein each of said glare shields includes a planar top surface upwardly sloping away from a corresponding one of said lenses; said glare shields Including a rear surface directly abutted against said opaque reflectors and said rubber seals respectively.

3. The device of claim 1, further comprising: a plurality of fastening members for threadably connecting said lenses to the mask support rim.

4. The device of claim 1, wherein said power supply source comprises: a battery pack oppositely disposed from said control switch.

5. The device of claim 1, wherein said mounting brackets extend rearwardly beyond said light-emitting sources and said reflector for assisting to maintain the light rays reflected therefrom at a substantially fixed path.

6. The device of claim 2, wherein said glare shield is formed from opaque material.

* * * * *